US005582261A

United States Patent [19]

Keith et al.

[11] Patent Number: 5,582,261

[45] Date of Patent: Dec. 10, 1996

[54] DRILL BIT HAVING ENHANCED CUTTING STRUCTURE AND STABILIZING FEATURES

[75] Inventors: Carl W. Keith, Spring; Graham Mensa-Wilmot, Houston, both of Tex.

[73] Assignee: Smith International, Inc., Houston, Tex.

[21] Appl. No.: 288,489

[22] Filed: Aug. 10, 1994

[51] Int. Cl.[6] ..... E21B 10/46

[52] U.S. Cl. ..... 175/431; 175/434

[58] Field of Search ..... 175/335, 350, 175/378, 379, 431, 434

[56] References Cited

U.S. PATENT DOCUMENTS

| | | | |
|---|---|---|---|
| Re. 33,757 | 12/1991 | Weaver | 175/329 |
| Re. 34,435 | 11/1993 | Warren et al. | 175/398 |
| 4,429,755 | 2/1984 | Williamson | 175/329 |
| 4,444,281 | 4/1984 | Schumacher et al. | 175/431 X |
| 4,471,845 | 9/1984 | Jürgens | 175/329 |
| 4,475,606 | 10/1984 | Crow | 175/431 |
| 4,512,426 | 4/1985 | Bidegaray | 175/329 |
| 4,545,441 | 10/1985 | Williamson | 175/329 |
| 4,718,505 | 1/1988 | Fuller | 175/329 |
| 4,932,484 | 6/1990 | Warren et al. | 175/431 |
| 4,942,933 | 7/1990 | Barr et al. | 175/329 |
| 5,033,560 | 7/1991 | Sawyer et al. | 175/410 |
| 5,131,478 | 7/1992 | Brett et al. | 175/431 X |
| 5,178,222 | 1/1993 | Jones et al. | 175/431 X |
| 5,186,268 | 2/1993 | Clegg | 175/431 X |
| 5,222,566 | 6/1993 | Taylor et al. | 175/431 |
| 5,238,075 | 8/1993 | Keith et al. | 175/431 |
| 5,244,039 | 9/1993 | Newton, Jr. et al. | 175/431 |
| 5,265,685 | 11/1993 | Keith et al. | 175/431 |
| 5,346,025 | 9/1994 | Keith et al. | 175/431 X |
| 5,377,773 | 1/1995 | Tibbits | 175/397 |

*Primary Examiner*—William P. Neuder

*Attorney, Agent, or Firm*—Gregory L. Maag; Conley, Rose & Tayon, P.C.

[57] ABSTRACT

A fixed cutter drill bit includes sets of cutter elements mounted on the bit face, each set including at least two cutters that are mounted at generally the same radial position with respect to the bit axis. The cutter elements of a set are positioned on different blades of the bit and are mounted having their cutting faces are out-of-profile, such that certain elements in the set are exposed to the formation material to a greater extent than other cutter elements in the same set. The cutter elements in a set may have equal diameters or may vary in size. The bit exhibits increased stability or vibration resistance, and drills initially as a "light-set" bit and later as a "heavy-set" bit.

44 Claims, 5 Drawing Sheets

DRILL BIT HAVING ENHANCED CUTTING STRUCTURE AND STABILIZING FEATURES

FIELD OF THE INVENTION

This invention relates generally to fixed cutter drill bits of the type typically used in cutting rock formation such as used in drilling an oil well or the like. More particularly, the invention relates to bits utilizing polycrystalline diamond cutting elements that are mounted on the face of the drill bit, such bits typically referred to as "PDC" bits.

BACKGROUND OF THE INVENTION

In drilling a borehole in the earth, such as for the recovery of hydrocarbons or for other applications, it is conventional practice to connect a drill bit on the lower end of an assembly of drill pipe sections which are connected end-to-end so as to form a "drill string." The drill string is rotated by apparatus that is positioned on a drilling platform located at the surface of the borehole. Such apparatus turns the bit and advances it downwardly, causing the bit to cut through the formation material by either abrasion, fracturing, or shearing action, or through a combination of all cutting methods. While the bit is rotated, drilling fluid is pumped through the drill string and directed out of the drill bit through flow channels that are formed in the bit. The drilling fluid is provided to cool the bit and to flush cuttings away from the cutting structure of the bit and upwardly into the annulus formed between the drill string and the borehole.

Many different types of drill bits and cutting structures for bits have been developed and found useful in drilling such boreholes. Such bits include fixed cutter bits and roller cone bits. The types of cutting structures include milled tooth bits, tungsten carbide insert ("TCI") bits, PDC bits, and natural diamond bits. The selection of the appropriate bit and cutting structure for a given application depends upon many factors. One of the most important of these factors is the type of formation that is to be drilled, and more particularly, the hardness of the formation that will be encountered. Another important consideration is the range of hardnesses that will be encountered when drilling through layers of differing formation hardness.

Depending upon formation hardness, certain combinations of the above-described bit types and cutting structures will work more efficiently and effectively against the formation than others. For example, a milled tooth bit generally drills relatively quickly and effectively in soft formations, such as those typically encountered at shallow depths. By contrast, milled tooth bits are relatively ineffective in hard rock formations as may be encountered at greater depths. For drilling through such hard formations, roller cone bits having TCI cutting structures have proven to be very effective. For certain hard formations, fixed cutter bits having a natural diamond cutting structure provide the best combination of penetration rate and durability. In formations of soft and medium hardness, fixed cutter bits having a PDC cutting structure are employed with good results.

The cost of drilling a borehole is proportional to the length of time it takes to drill the borehole to the desired depth and location. The drilling time, in turn, is greatly affected by the number of times the drill bit must be changed, in order to reach the targeted formation. This is the case because each time the bit is changed the entire drill string, which may be miles long, must be retrieved from the borehole section by section. Once the drill string has been retrieved and the new bit installed, the bit must be lowered to the bottom of the borehole on the drill string which again must be constructed section by section. As is thus obvious, this process, known as a "trip" of the drill string, requires considerable time, effort and expense. Accordingly, it is always desirable to employ drill bits which will drill faster and longer and which are usable over a wider range of differing formation hardnesses.

The length of time that a drill bit may be employed before it must be changed depends upon its rate of penetration ("ROP"), as well as its durability or ability to maintain a high or acceptable ROP. Additionally, a desirable characteristic of the bit is that it be "stable" and resist vibration, the most severe type or mode of which is "whirl," which is a term used to describe the phenomenon where a drill bit rotates at the bottom of the borehole about a rotational axis that is offset from the geometric center of the drill bit. Such whirling subjects the cutting elements on the bit to increased loading, which causes the premature wearing or destruction of the cutting elements and a loss of penetration rate.

In recent years, the PDC bit has become an industry standard for cutting formations of soft and medium hardnesses. The cutting elements used in such bits are formed of extremely hard materials and include a layer of thermally stable polycrystalline diamond material. In the typical PDC bit, each cutter element or assembly comprises an elongate and generally cylindrical support member which is received and secured in a pocket formed in the surface of the bit body. A disk or tablet-shaped, preformed cutting element having a thin, hard cutting layer of polycrystalline diamond is bonded to the exposed end of the support member, which is typically formed of tungsten carbide.

Because of advancements made in both diamond technology and in the design of PDC bit cutting structures, PDC bits have been successfully employed in formations having up to a medium hardness, a degree or level of hardness that previously prohibited the use of such bits. As PDC bits were being developed for use in such harder formations, their cutting structures were designed so as to be "heavy set," which means that the bit was provided with a large number of cutter elements distributed about the face of the bit such that each of the elements would remove a comparatively small amount of material from the formation during each revolution and would be subjected to a loading that was less than the loading that would be experienced by the cutter elements if fewer cutter elements were provided. This arrangement is to be contrasted with a "light set" bit which had proven successful in softer formations and which has a comparatively fewer number but larger sized cutter elements, each of which would remove a greater volume of formation material than the elements used in a "heavy set" bit.

Because of the difference in design and construction of the heavy set and light set PDC bits, inefficiencies resulted when using one of these bit designs to drill through formations of differing hardness. For example, if a heavy set bit was used for the reason that a lower formation layer had a relatively high degree of hardness compared to a softer upper layer, the heavy set bit tended to clog in the softer formations, resulting in a reduced ROP in that section of the borehole. Alternatively, if a light set bit was used, the ROP in the hard formation was relatively slow in comparison to the rate that could be achieved using a heavy set bit. Thus, where PDC bits were to be used, it was frequently necessary to accept lower ROP's while drilling through formations of one degree of hardness or another, or to trip the drill string and change the drill bits when drilling through formations of differing hardness. Either of these alternatives could be extremely costly.

A common arrangement of the PDC cutting elements was at one time to place them in a spiral configuration. More specifically, the cutter elements were placed at selected radial positions with respect to the central axis of the bit, with each element being placed at a more remote radial position than the preceding element. So positioned, the path of all but the centermost elements partly overlapped the path of movement of a preceding cutter element as the bit was rotated. Thus, each element would remove a lesser volume of material than would be the case if it were radially positioned so that no overlapping occurred, or occurred to a lesser extent, because the leading cutter element would already have removed some formation material from the path traveled by the following cutter element. Although the spiral arrangement was once widely employed, this arrangement of cutter elements was found to wear in a manner to cause the bit to assume a cutting profile presenting a relatively flat and single continuous cutting edge from one element to the next. Not only did this decrease the ROP that the bit could provide, it but also increased the likelihood of bit vibration.

Preventing bit vibration and maintaining stability of PDC bits has long been a desirable goal, but one which has not always been achieved. Bit vibration typically may occur in any type of formation, but is most detrimental in the harder formations. As described above, the cutter elements in many prior art PDC bits were positioned in a spiral relationship which, as drilling progressed, wore in a manner which caused the ROP to decrease and which also increased the likelihood of bit vibration.

There have been a number of designs proposed for PDC cutting structures that were meant to provide a PDC bit capable of drilling through a variety of formation hardnesses at effective ROP's and with acceptable bit life or durability. For example, U.S. Pat. No. 5,033,560 (Sawyer et al.) describes a PDC bit having mixed sizes of PDC cutter elements which were arranged in an attempt to provide improved ROP while maintaining bit durability. Similarly, U.S. Pat. No. 5,222,566 (Taylor et al.) describes a drill bit which employs PDC cutter elements of differing sizes, with the larger size elements employed in a first group of cutters and the smaller size employed in a second group, the patent describing such a bit as tending to act as a "heavy set" bit in certain formations and as a "light set" bit in other softer formations. This design however suffered from the fact that the cutter elements did not share the cutting load equally. Instead, the blade on which the larger sized cutters were grouped was loaded to a greater degree than the blade with the smaller cutter elements. This could lead to blade failure. Additionally, the placement of the nozzles in this design could limit design flexibility and drilling applications.

Separately, other attempts have been made at solving bit vibration. For example, U.S. Pat. No. Re. 34,435 (Warren et al.) describes a bit intended to resist vibration that includes a set of cutters which are disposed at an equal radius from the center of the bit and which extend further from the bit face than the other cutters on the bit. According to that patent, the set of cutters extending furthest from the bit face are provided so as to cut a groove within the formation that tends to stabilize the bit. Similarly, U.S. Pat. No. 5,265,685 (Keith et al.) discloses a PDC bit that is designed to cut a series of grooves in the formation such that the resulting ridges formed between each of the concentric grooves tends to stabilize the bit. U.S. Pat. Nos. Re. 34,435 and 5,265,685 both disclose using the same sized cutter elements. U.S. Pat. No. 5,238,075 (Keith et al.) also describes a PDC bit having a cutter element arrangement which employs cutter elements of different sizes and which, in part, was hoped to provide greater stabilization. However, many of these designs aimed at minimizing vibration required that drilling be conducted with an increased weight-on-bit (WOB) as compared with bits of earlier designs. Drilling with an increased or heavy WOB has serious consequences and is avoided whenever possible. Increasing the WOB is accomplished by adding additional heavy drill collars to the drill string. This additional weight increases the stress and strain on all drill string components, causes stabilizers to wear more and to work less efficiently, and increases the hydraulic pressure drop in the drill string, requiring the use of higher capacity (and typically higher cost) pumps for circulating the drilling fluid.

Thus, despite attempts and certain advances made in the art, there remains a need for a PDC bit having an improved cutter arrangement which will permit the bit to drill effectively at economical ROP's without excessive WOB and, ideally, in formations having a hardness greater than that in which conventional PDC bits can be employed. More specifically, there is a need for a PDC bit which can drill in soft, medium, medium hard and even in some hard formations while maintaining an aggressive cutter profile so as to maintain acceptable ROP's for acceptable lengths of time and thereby lower the drilling costs presently experienced in the industry. Ideally, such a bit would also provide an increased measure of stability so as to resist bit vibration and do so without having to employ substantial additional WOB.

SUMMARY OF THE INVENTION

Accordingly, there is provided herein a drill bit particularly suited for drilling through a variety of formation hardnesses with normal WOB at improved penetration rates while maintaining stability and resisting bit vibration. The bit has the characteristics of a light set bit when drilling is initiated and, after some wear has occurred, takes on the characteristics of a heavy set bit, as desirable for drilling through harder formations. The bit may be successfully employed in formations of greater hardness than can typically be drilled using conventional PDC bits.

The bit generally includes a bit body and a cutting face which includes a plurality of sets of cutter elements mounted on the bit face. The cutter elements in a set are mounted on the bit face at generally common radial positions relative to the bit axis, such that the elements in a set tend to follow the same circular path. The elements in a set are mounted at varying mounting heights relative to the bit face, such that those elements extending further are more exposed to the formation material than those which are mounted at a relatively lower height from the bit face. A set may include either one or several cutter elements at the same mounting height and having the same cutting profile. In this configuration, certain of the cutter elements in a set are partially hidden from the formation material until a certain degree of bit wear occurs on the more exposed cutter elements. Given this relationship, the bit will initially drill as a light set bit. As drilling progresses, the more exposed cutter elements in a set will gradually wear until the bit takes on the characteristics of a heavy set bit as is useful for drilling in the harder formations.

The cutter elements may be disposed about the bit face in radially extending rows on angularly spaced apart blades of the bit. The higher set or greater exposed elements in a set may all be positioned on a first blade, with lower set and less exposed elements trailing behind it on a second blade angularly displaced from the first. Alternatively, the blades may each include the higher exposed and lower exposed cutter elements which may be disposed in a repeating pattern along the blade so that the blades will be more equally loaded. A particularly desirable pattern is to alternate higher and lower exposed cutter elements along the cutting profile of each blade.

Each set may consist of two, three or more cutter elements. The cutter elements in a set may have cutting faces of equal diameter or, alternatively, may include cutting faces of varying diameters. Where cutters having varying sized cutter faces are employed, the cutter having the smallest cutting face will be mounted so as to have the greatest exposure to the formation, while the cutter having the largest cutting face diameter will have the least exposure to the formation. This arrangement increases the stability of the bit by creating relatively tall and sharply tapered ridges between the kerfs which provide the side forces helpful in resisting bit vibration.

Thus, the present invention comprises a combination of features and advantages which enable it to substantially advance the drill bit art by providing apparatus for effectively and efficiently drilling through a variety of formation hardnesses at economic rates of penetration and with superior bit durability. The bit drills with less vibration and greater stability, and because it does not also require additional or excessive WOB, drills more economically than many prior art PDC bits. These and various other characteristics and advantages of the present invention will be readily apparent to those skilled in the art upon reading the following detailed description of the preferred embodiments of the invention, and by referring to the accompanying drawings.

BRIEF DESCRIPTION OF THE DRAWINGS

For a detailed description of the preferred embodiment of the invention, reference will now be made to the accompanying drawings, wherein.

DESCRIPTION OF THE PREFERRED EMBODIMENT

Figure 1:
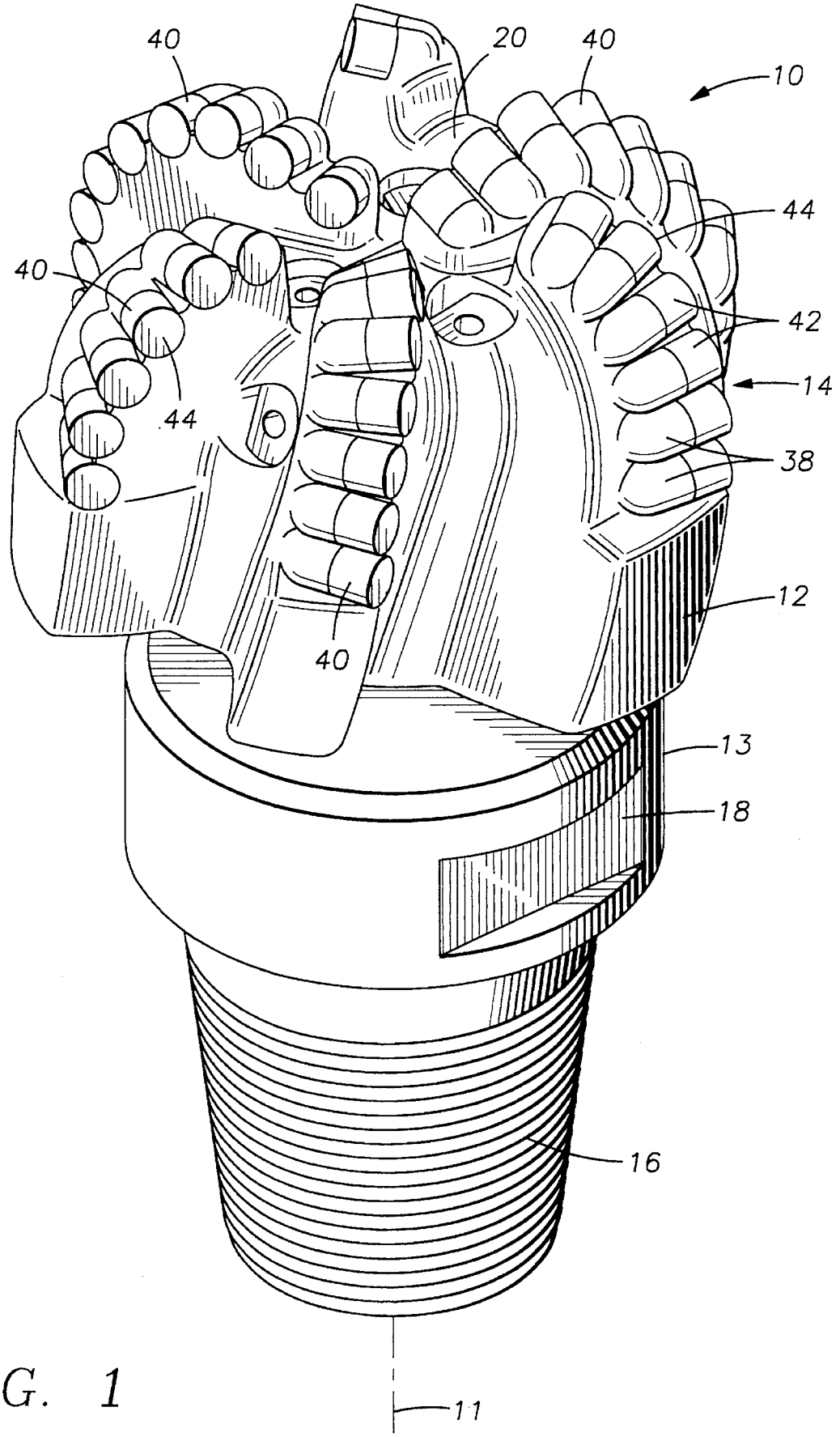
FIG. 1 is a perspective view of a drill bit made in accordance with the present invention.
Figure 2:
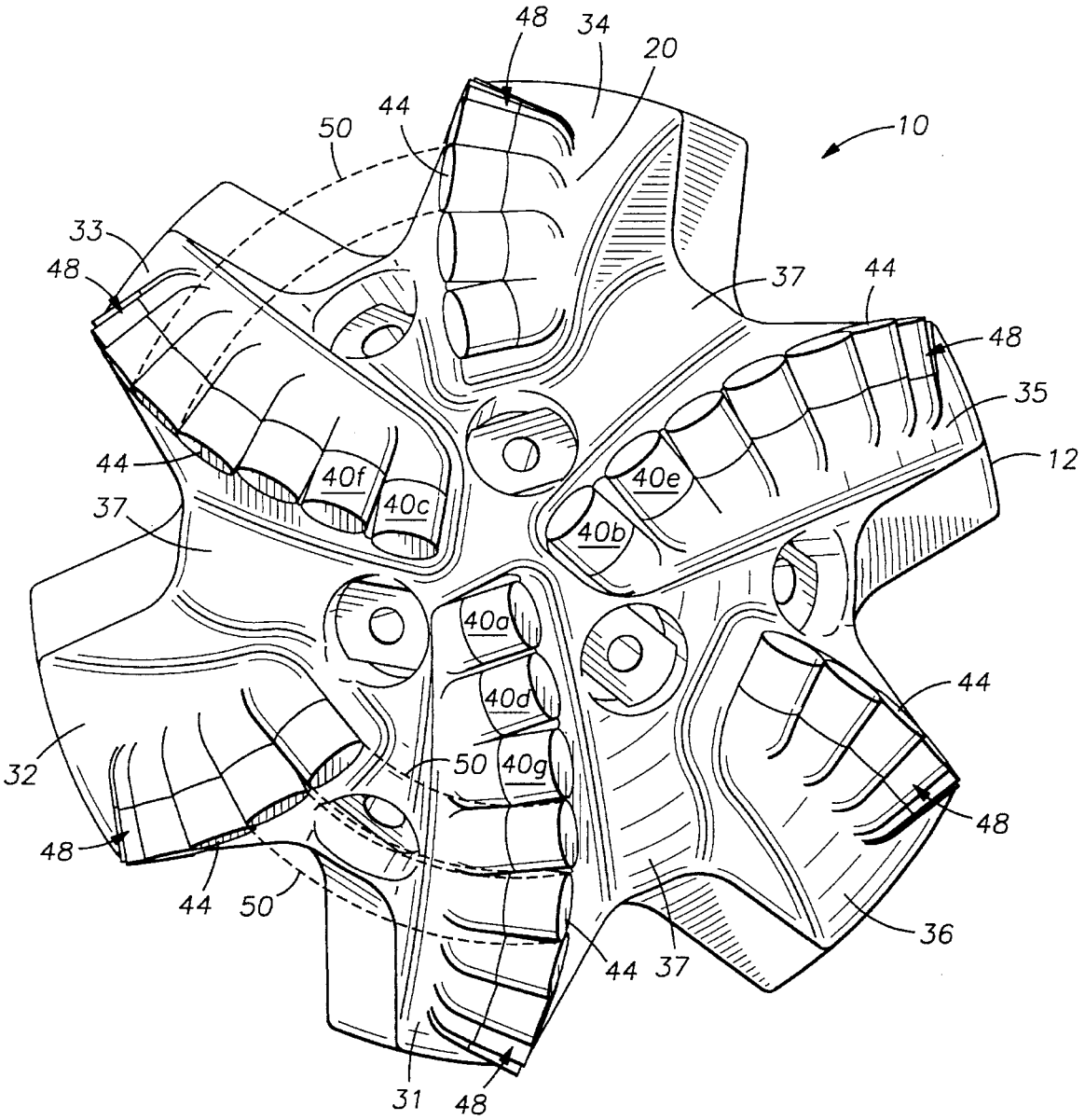
FIG. 2 is a plan view of the cutting end of the drill bit shown in FIG. 1.
Figure 3:
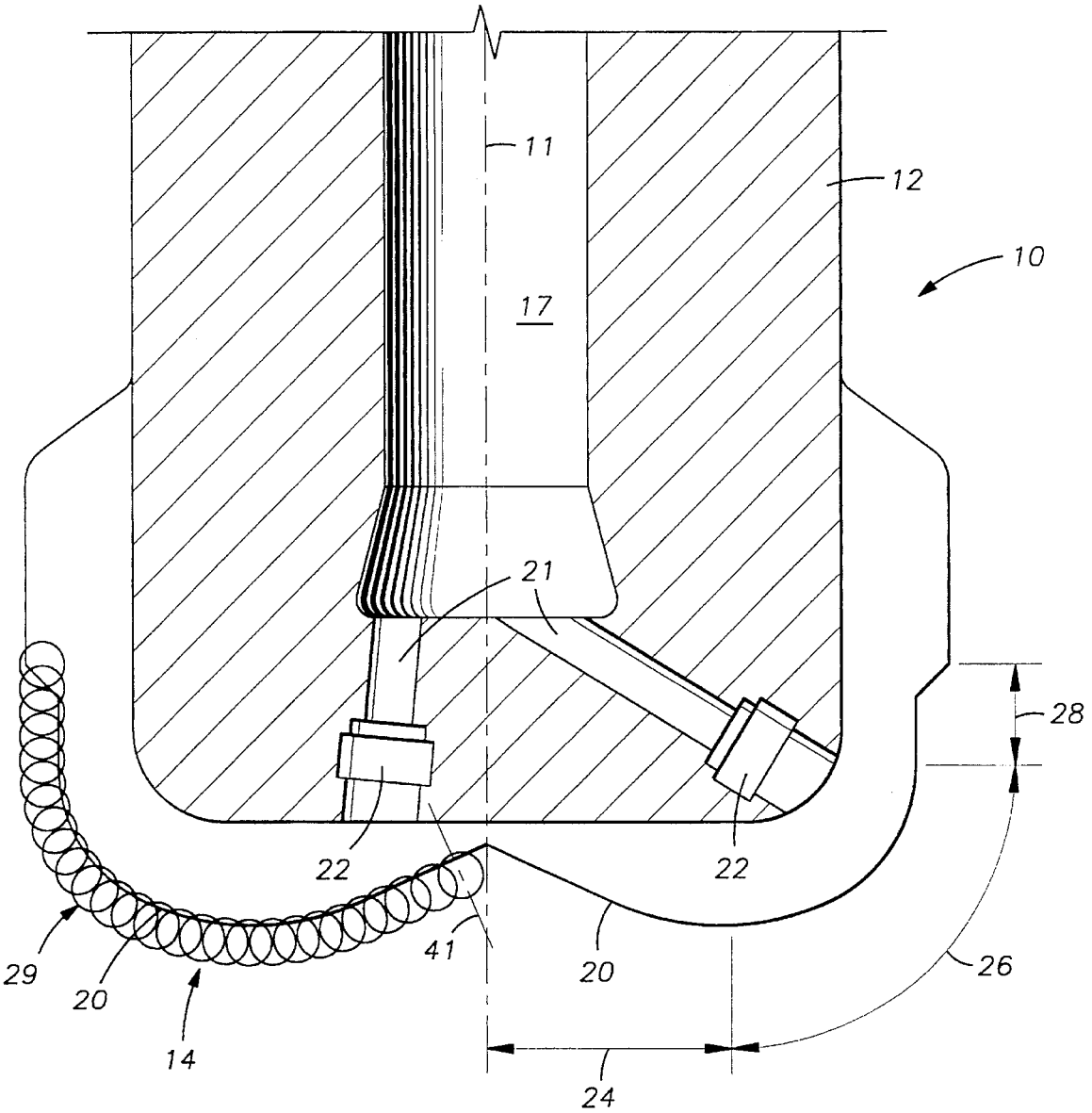
FIG. 3 is an elevational view, partly in cross-section, of the drill bit shown in FIG. 1 with the cutter elements shown in rotated profile collectively on one side of the central axis of the drill bit.

A drill bit 10 embodying the features of the present invention is shown in FIGS. 1–3. Bit 10 is a fixed cutter bit, sometimes referred to as a drag bit, and is adapted for drilling through formations of rock to form a borehole. Bit 10 generally includes a bit body 12, shank 13, and threaded connection or pin 16 for connecting bit 10 to a drill string (not shown) which is employed to rotate the bit for drilling the borehole. Bit 10 further includes a central axis 11 and a PDC cutting structure 14.

Body 12 includes a central longitudinal bore 17 (FIG. 3) for permitting drilling fluid to flow from the drill string into the bit. A pair of oppositely positioned wrench flats 18 (one shown in FIG. 1) are formed on the shank 13 and are adapted for fitting a wrench to the bit to apply torque when connecting and disconnecting bit 10 from the drill string.

Bit body 12 includes a bit face 20 which is formed on the end of the bit 10 that is opposite pin 16 and which supports cutting structure 14, described in more detail below. Body 12 is formed in a conventional manner using powdered metal tungsten carbide particles in a binder material to form a hard metal cast matrix. Steel bodied bits, those machined from a steel block rather than a formed matrix, may also be employed in the invention. In the preferred embodiment shown, bit face 20 includes six angularly spaced-apart blades 31–36 which are integrally formed as part of and which extend from body 12. Blades 31–36 extend radially across the bit face 20 and longitudinally along a portion of the periphery of the bit. Blades 31–36 are separated by grooves which define drilling fluid flow courses 37 between and along the cutting faces 44 of the cutter elements 40, which are mounted on bit face 20 and described in more detail below. Again in the preferred embodiment shown in FIG. 2, blades 31, 33 and 35 are equally spaced 120° apart, while blades 32, 34 and 36 lag behind blades 31, 33 and 35 by 55°. Given this angular spacing, blades 31–36 may be considered to be divided into pairs of "leading" and "lagging" blades, a first such pair comprising blades 31 and 32, a second pair comprising blades 33 and 34, and a third pair including blades 35 and 36.

As best shown in FIG. 3, body 12 is also provided with downwardly extending flow passages 21 having nozzles 22 disposed at their lowermost ends. In the preferred embodiment, bit 10 includes six such flow passages 21 and nozzles 22. The flow passages 21 are in fluid communication with central bore 17. Together, passages 21 and nozzles 22 serve to distribute drilling fluids around the cutter elements 40 for flushing formation cuttings from the bottom of the borehole and away from the cutting faces 44 of cutter elements 40 when drilling.

Referring now to FIG. 3, to aid in an understanding of the more detailed description which follows, bit face 20 may be said to be divided into three different zones or regions 24, 26, 28. The central portion of the bit face 20 is identified by the reference numeral 24 and may be concave as shown. Adjacent central portion 24 is the shoulder or the upturned curved portion 26 which leads to the gage portion 28, which is the portion of the bit face 20 which defines the diameter or gage of the borehole drilled by bit 10. As will be understood by those skilled in the art, regions 24, 26, 28 are approximate and are identified only for the purposes of better describing the distribution of cutter elements 40 over the bit face 20, as well as other inventive features of the present invention.

As best shown in FIG. 1, each cutter element 40 is mounted within a pocket 38 which is formed in the bit face 20 on one of the radially and longitudinally extending blades 31–36. Cutter elements 40 are constructed by conventional methods and each typically includes a generally cylindrical base or support 42 having one end secured within a pocket 38 by brazing or similar means. The support 42 is comprised of a sintered tungsten carbide material having a hardness greater than that of the body matrix material. Attached to the opposite end of the support 42 is a layer of extremely hard material, preferably a synthetic polycrystalline diamond material which forms the cutting face 44 of element 40. Such cutter elements 40, generally known as polycrystalline diamond composite compacts, or PDC's, are commercially available from a number of suppliers including, for example, Smith Sii Megadiamond, Inc. or General Electric Company, which markets compacts under the trademark STRATAPAX.

As shown in FIGS. 1 and 2, the cutter elements 40 are arranged in separate rows 48 along the blades 31–36 and are positioned along the bit face 20 in the regions previously described as the central portion 24, shoulder 26 and gage portion 28. The cutting faces 44 of the cutter elements 40 are oriented in the direction of rotation of the drill bit 10 so that the cutting face 44 of each cutter element 40 engages the earth formation as the bit 10 is rotated and forced downwardly through the formation. Cutter elements 40 are mounted on the blades 31–36 in selected radial positions relative to the central axis 11 of the bit 10. Referring momentarily to FIG. 3, each of the cutters 40 is positioned with an element mounting axis 41 (one shown in FIG. 3) extending normal to the bit face 20.

Figure 4:
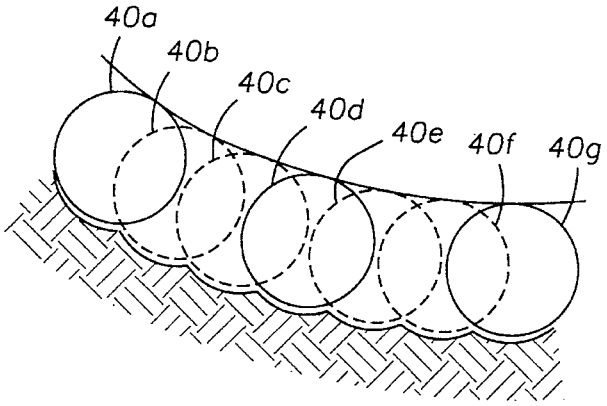
FIG. 4 is an enlarged view of a portion of FIG. 3 showing the overlapping of the cutting profiles of the cutter elements located adjacent to the bit axis.

Referring again to FIGS. 2 and 3, each row 48 includes a number of cutter elements 40 radially spaced from each other relative to the bit axis 11. As is well known in the art, cutter elements 40 are radially spaced such that the groove or kerf formed by a cutter element 40 overlaps to a degree with kerfs formed by one or more cutter elements 40 of other rows 48. Such overlap is best understood by referring to FIG. 4 which schematically shows, in rotated profile, the relative radial positions of the most centrally located cutter elements 40, that is, those elements 40 positioned closest to bit axis 11 which have been identified in FIGS. 2 and 4 with the reference characters 40*a*–40*g*. As shown, elements 40*a*, 40*d* and 40*g* are radially spaced in a first row 48 on blade 31. As bit 10 is rotated, these elements will cut separate kerfs in the formation material, leaving ridges therebetween. As the bit 10 continues to rotate, cutter elements 40*b* and 40*c*, mounted on blades 35 and 33, respectively, will cut the ridge that is left between the kerfs made by cutter elements 40*a* and 40*d*. Likewise, elements 40*e* and 40*f* (also on blades 35 and 33) cut the ridge between the kerfs formed by elements 40*d* and 40*g*. With this radial overlap of cutter 40 profiles, the cutting profile of bit 10 may be generally represented by the relatively smooth curve 29 as shown in FIG. 3 which shows the cutter elements 40 of the bit 10 in rotated profile collectively on one side of central bit axis 11.

As will be understood from the disclosure which follows, certain cutter elements 40 are positioned on the bit face 20 at generally the same radial position as other elements 40 and follow in the swath of kerf cut by a preceding cutter element 40. As such, in the rotated profile of FIG. 3, the distinction between certain cutter elements cannot be seen. Further, as explained below, the present invention provides that some of the cutter elements 40 that are disposed in generally the same radial position be mounted at different heights relative to the bit face such that the cutting faces 44 of these elements present staggered or offset cutting profiles. Again as explained below, the cutter elements 40 may be mounted such that their cutting profiles are offset in a direction parallel to the elements' axes or in a direction parallel to the bit axis 11. In either arrangement, these differences in exposure height are not visible in FIG. 3 but are described below in more detail with reference to FIGS. 5–9.

In addition to being mounted in rows 48, cutter elements 40 are also arranged in groups or sets 50, each cutter set 50 including cutter elements 40 from various rows 48 that have the same general radial position with respect to bit axis 11. Cutter element sets 50 may include two, three or any greater number of cutter elements 40. In one particularly preferred embodiment of the invention, each cutter set 50 includes two elements 40, each of the elements 40 in the set 50 being located on a different blade 31–36. For illustrative purposes, three of such sets 50 are generally identified in FIG. 2. The cutter elements 40 within a set 50 are mounted so as to have varying exposure heights above the bit face 20. Such exposure height variance may be in a direction parallel to the axes 41 of elements 40, as described with reference to FIG. 5, or may be in a direction parallel to bit axis 11, as described with reference to FIG. 9.

Figure 5:
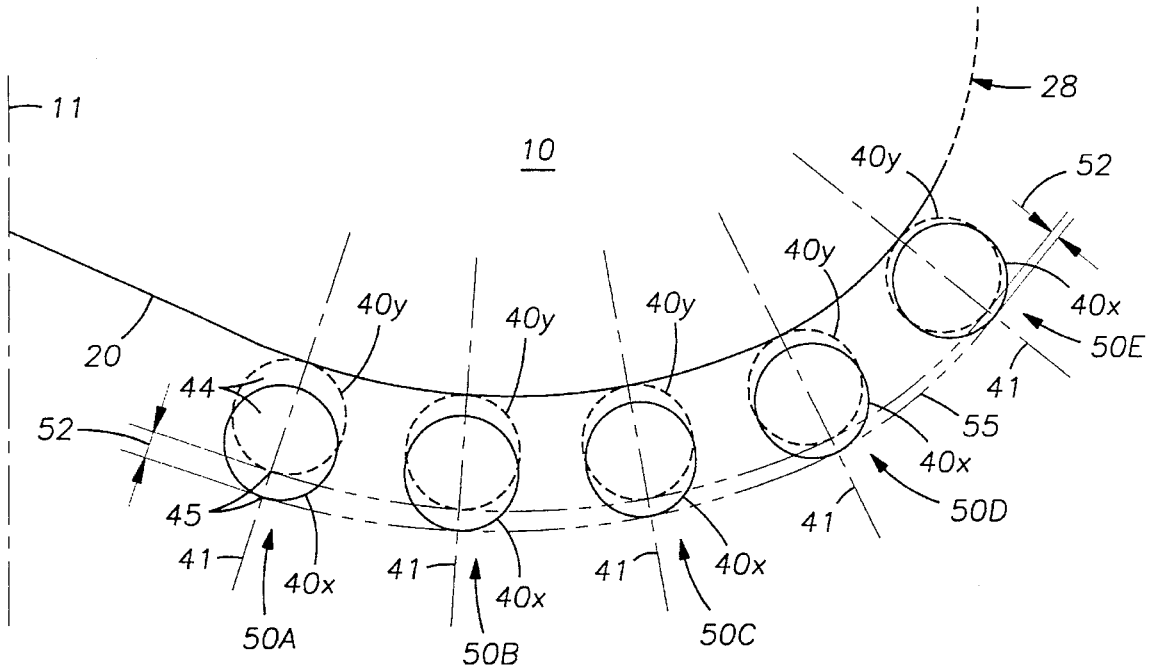
FIG. 5 is an enlarged view similar to FIG. 4 showing schematically, in rotated profile, the relative radial positions and exposure heights of the cutter elements that are mounted on the drill bit shown in FIG. 1.

Referring now to FIG. 5, five cutter element sets 50A–E are shown in rotated profile in relation to bit axis 11. The cutter elements 40 of a set 50 include cutting faces of substantially equal diameters and are mounted on bit face 20 with their element axes 41 aligned and normal to face 20. Because the bit face 20 is curved, and because the axes 41 of elements 40 are aligned and normal to the bit face 20, cutters 40 in a set 50 do not have exactly the same radial position with respect to bit axis 11, except where the elements' aligned axes 41 are parallel to the bit axis 11. Nevertheless, because the elements 40 in each set 50 cut in the same circular path, the elements may fairly be said to generally have the same or a common radial position. One cutter element 40X in each set 50 is mounted on bit face 20 such that its cutting face 44 is exposed to the formation material below the bit to a greater extent than the other cutter element 40Y of the same set 50. The elements 40X will, at least initially before significant wear occurs, cut deeper swaths or kerfs in the formation material than the less exposed elements 40Y of the set. This difference in exposure or offset of elements 40X and 40Y measured between the edges of their respective cutting faces 44 can be described as an exposure variance and is identified by reference numeral 52. As shown in the embodiment of FIG. 5, the exposure variance 52 preferably decreases with each radially spaced set 50 upon moving from axis 11 toward the gage portion 28 of bit face 20. As an example, the exposure variance 52 between cutter elements 40X and 40Y of set 50A located in the central portion 24 of bit face 20 is preferably about 0.060 inches. For cutter set 50E that is disposed at a location on the shoulder portion 26 of bit face 20, adjacent to gage portion 28, the exposure variance may be only 0.030 inches.

In the embodiment shown in FIG. 5, cutter elements 40X and 40Y are mounted on different blades 31–36. For example, referring momentarily to FIG. 2, elements 40X are preferably mounted on the blade 32 while elements 40Y are mounted on angularly spaced blade 31 which includes a greater number of cutter elements 40. While this embodiment of the invention is shown in FIGS. 1 and 2 on a six-bladed bit 10, the principles of the present invention can be employed in bits having any number of blades, and the invention is not limited to a bit having any particular number of blades or angular spacing of the blades. Further, although sets 50 are shown in FIGS. 2 and 5 as including only two cutter elements 40, the invention may include a greater number of elements in sets 50. Referring generally to FIG. 5, the sets 50A–50E may include several cutter elements having the same cutting profile as that of cutter 40X and several others having the same cutting profile as that of cutter element 40Y. For example, bit face 20 may have a cutter set 50A which includes four cutter elements 40 mounted at the same height such that, in rotated profile, all four elements 40 have the same cutting profile as the element designated as 40X. This same set 50A may simultaneously include two cutter elements 40 that, in rotated profile, have the same cutting profile as that dement shown as 40Y. In the embodiment thus described, set 50B may have four cutters having the cutting profile of 40Y and only two having the cutting profile of 40X. It is believed that by providing redundancy with respect to elements 40X and 40Y in a set 50A, and by varying (or alternating for example) the degree of redundancy between adjacent sets 50A and 50B, that even greater bit stability can be achieved.

Referring still to FIGS. 2 and 5, as the bit 10 is rotated about its axis 11, the blades 31–36 sweep around the bottom of the borehole causing the more exposed cutter elements 40X to each cut a trough or kerf within the formation material. As is apparent, the depth of the kerf formed by each cutter element 40X is dependant upon the extent to which the element 40X extends from cutting face 20 of bit 10. Cutter elements 40Y follow in the kerfs cut by the corresponding element 40X. Because elements 40Y are not exposed to the same extent to the formation as elements 40X, they are not called upon to cut as great a volume of formation material as do the more exposed elements 40X. In this regard, elements 40Y may be considered partially "hidden" from the formation by elements 40X.

As shown in FIG. 5, cutter sets 50A–E are radially spaced from one another such that ridges will be formed as sets 50 cut kerfs in the formation when the bit 10 is rotated. In a similar manner to that described previously with reference to FIG. 4, other sets 50 of cutter elements 40 that are mounted on blades 33–36 will follow behind cutter sets 50A–E in a radially overlapping fashion so as to cut the ridges between sets 50A–E and yield a relatively smooth cutting profile 55.

When bit 10 having the cutter arrangement shown in FIG. 5 is first placed in the borehole, it has the characteristics of a light set bit. This is because the elements 40Y are at least partially hidden from the formation and perform very little cutting relative to that performed by cutter elements 40X. As bit 10 is rotated, it is also forced downwardly against the formation material with great force. In relatively soft formations, bit 10 will drill hole with very little wear being experienced by any of the cutter elements 40. As the formation material penetrated by the bit 10 becomes harder, however, elements 40X, which to this point are supporting most of the cutting load, will begin to wear. As drilling continues, elements 40X will eventually wear to the extent that elements 40Y are no longer hidden, such that elements 40X and 40Y will begin to cut substantially equal volumes of formation and will be subjected to substantially equal loading. At this point, the bit 10 has the characteristics of a heavy set bit as is desirable for cutting in harder formations. Also, the combination of elements in sets 50, which in this state of wear include some sharp and some dull cutter elements 40, will tend to reduce vibration and increase bit stability. This arrangement of cutter elements 40 at generally the same radial position but at varying exposures has proven highly successful in soft and medium hardness formations.

Variations or alternative embodiments to the drill bit and cutter arrangement previously described are shown in FIGS. 6–9. In describing these alternative embodiments, similar reference numerals and characters will be used to identify like or common elements.

Figure 9:
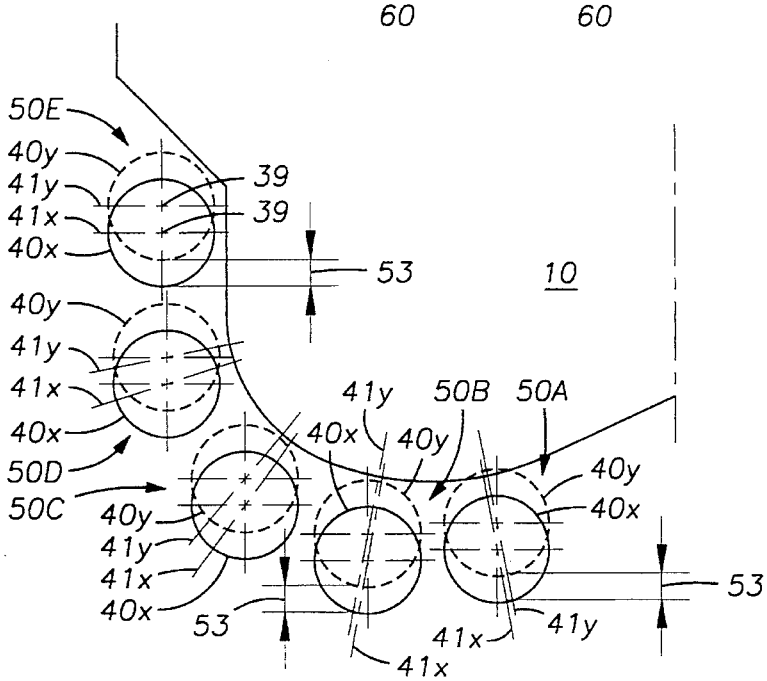

Referring now to FIG. 9, an alternative embodiment of the invention is shown in which the cutter elements 40 of sets 50 are offset or displaced from one another in a direction that is substantially parallel to bit axis 11. As shown, bit 10 includes cutter element sets 50A–50E. The cutter elements 40 include cutting faces 44 of substantially equal diameters. The cutter elements 40 are mounted on bit face 20 such that the centers 39 of each cutting face 44 in a set 50 are equidistant from bit axis 11. Accordingly, cutter elements 40X and 40Y of each set 50 are positioned at the same radial position with respect to bit axis 11; however, their element mounting axes, 41X and 41Y respectively, although normal to bit face 20, are not aligned with each other as in the embodiment previously described and shown in FIG. 5. Thus, in the arrangement shown in FIG. 9, each set 50 includes at least one element 40X that is mounted on bit face 20 such that its cutting face 44, in rotated profile, is offset from the cutting profile of elements 40Y of the same set 50 by an exposure variance designated by the reference numeral 53. In this embodiment, the exposure variance 53 of cutter sets 50A–50E will all be identical, and may be, for example, approximately 0.060 inches.

Figure 6:
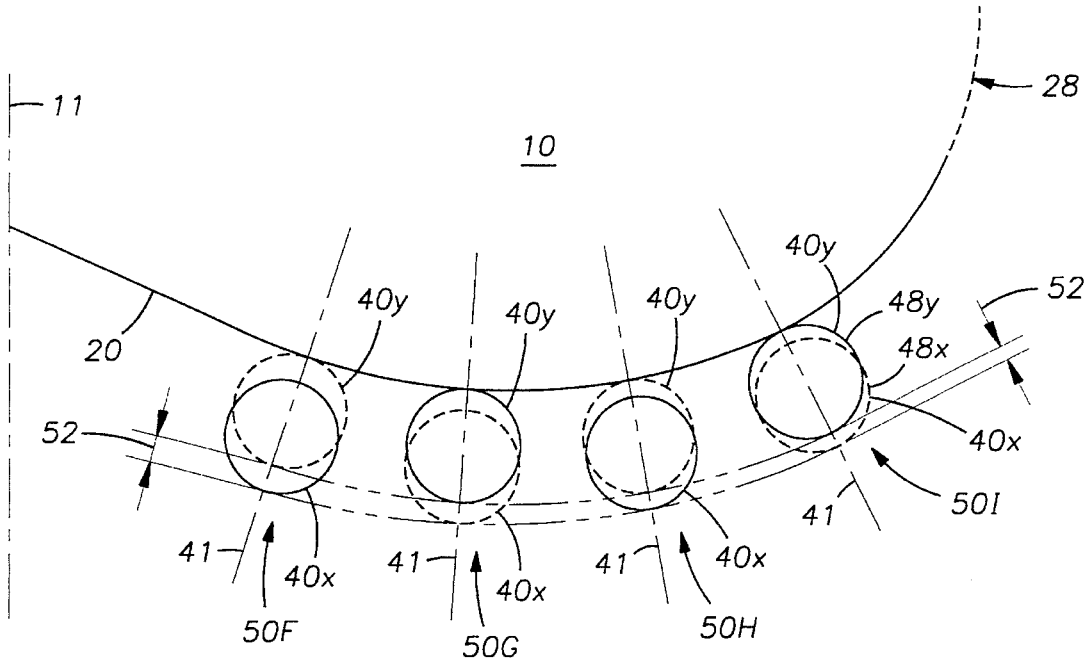
FIG. 6 is a view similar to FIG. 5 showing an alternative embodiment of the present invention.

Referring now to FIG. 6, bit 10 is shown to include four cutter sets 50F–I mounted on bit face 20 in radially-spaced relationship relative to bit axis 11. Each cutter set 50 includes a pair of cutter elements 40 having generally the same radial position and having cutting faces 44 of substantially the same diameter. Each cutter set 50 includes an element 40X that is exposed to a greater degree to the formation than the other element 40Y. Elements 40X and 40Y are mounted on bit face 20 with their element axes aligned and normal to face 20. In this embodiment, however, each blade 31–36 includes both types of elements 40X and 40Y mounted in alternating offset fashion along its radial length. More specifically, a first blade, for example, blade 32 (FIG. 2) is shown to include a row 48X of cutter elements 40 arranged so as to have the cutting profile shown in FIG. 6 by the cutting faces 44 depicted with the solid lines. A second blade, such as blade 31 (FIG. 2) will follow behind blade 32 and will have row 48Y of cutter elements arranged so as to have the cutter profile shown by the cutting faces 44 represented by the dashed lines. As is apparent, the arrangement of alternating highly exposed and less exposed cutter elements 40X and 40Y are reversed when comparing rows 48X and 48Y. As with the embodiment shown in FIG. 5, the exposure variance 52 between the cutting faces 44 of elements 40X and 40Y decreases across the cutting profile of bit 10 upon moving from axis 11 toward gage portion 28 of bit face 20.

Like the embodiment shown and described with reference to FIG. 5, the bit 10 of FIG. 6 initially has the characteristics of a light set bit given that one half of the total number of cutter elements 40 (elements 40Y) are partially hidden by the more exposed cutters 40X until harder formations wear elements 40X. When such wear occurs, the bit 10 assumes the characteristic of a heavy set bit where all cutter elements 40X and 40Y cut substantially equal volumes and generally share the loading equally. The alternating pattern of elements 40X and 40Y along rows 48 on blades 31–36 enable each blade 31–36 to share the load equally through out the drilling process. Thus, the embodiment of FIG. 6 has the additional advantage that the blades 31–36 are all substantially evenly loaded such that one blade is not required to endure most of the loading until cutter elements 40X wear, as is the case with the bit 10 described with reference to FIG. 5.

Substantially the same equal loading on blades 31–36 can be achieved through other alternating patterns of highly exposed and lesser exposed cutter elements 40X and 40Y. For example, beginning at a particular radial position and moving outwardly toward the gage portion 28 of the bit face 20, a blade 32 may include a row 48 of radially-spaced cutters 40 having the following pattern: 40X, 40X, 40Y, 40Y, 40X, 40X. In this example, the following blade 31 would then be provided with a corresponding row 48 having the following cutter pattern: 40Y, 40Y, 40X, 40X, 40Y, 40Y. As will be appreciated by those skilled in the art, a number of other similar patterns can also be employed.

Figure 7:
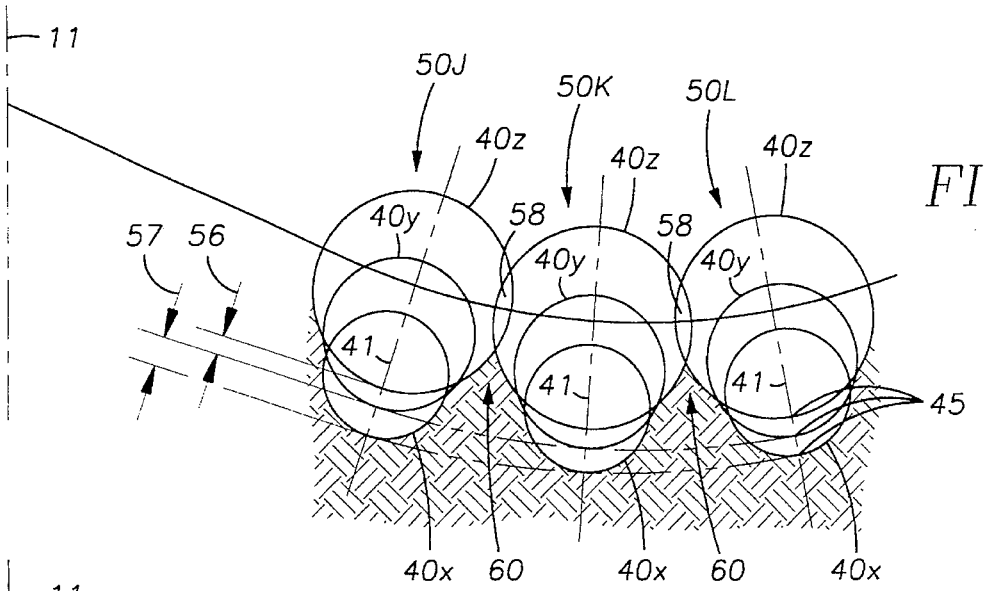
FIGS. 7, 8 and 9 are views similar to FIGS. 5 and 6 showing still further alternative embodiments of the present invention.

Another alternative embodiment of the invention is shown in FIG. 7. As shown, bit 10 includes a number of radially spaced cutter dement sets 50J–L. Cutter elements 40 within the same set 50 have generally the same radial position with respect to bit axis 11 and have their element axes 41 aligned and normal to bit face 20. Elements 40 of sets 50 are mounted at different heights on bit face 20 so as to create varying exposures for the elements 40 with respect to the formation that is being drilled. The cutter elements 40 having the greatest exposure are identified by reference character 40X. The cutter elements having the least exposure are shown as elements 40Z. Elements of intermediate exposure are identified by the reference character 40Y. The exposure variance between element 40Z and 40Y is represented by reference numeral 56. The exposure variance between element 40Y and 40Z is shown by reference numeral 57. Although such variances may vary, variances 56 and 57 may be, for example, approximately 0.030 and 0.030 inches respectively for sets 50 located in the central portion 24 of the bit face 20. Once again, these variances 56 and 57 will decrease upon moving away from bit axis 11 toward gage surface 28.

It is preferred that elements 40X, Y and Z have cutting faces 44 of different diameters. Ideally, elements 40X should have the smallest diameter while elements 40Z, which are positioned closest to the bit face 20 and have the smallest initial exposure to the formation have the largest diameter. As an example of acceptable cutter sizes, cutter elements 40X may have cutting faces having diameters of ¾ inch, with the cutting faces of cutter elements 40Y and 40Z having diameters of ⅝ inch and ½ inch, respectively. Additionally, cutter elements 40Z in adjacent radially spaced sets 50 will be positioned such that their cutting face profiles overlap, so as to form a region 58 of double cutter density.

The elements 40X, Y and Z in each set 50 are divided among a number of blades 31–36 on bit face 20. Obviously, for a three element set 50 as shown in FIG. 7, bit 10 will require at least three blades. Because the cutting profiles of cutter elements 40Z overlap radially and could therefor not be mounted in the same row 48 on the same blade, and so as to provide for more equal loading on all the blades, elements 40 are divided among the blades. For example, a first blade 31 may include a row 48 having radially spaced elements 40Z of cutter set 50J, 40Y of set 50K, and 40X of set 50L. The next blade 32 may include element 40X of set 50J, element 40Z of set 50K and element 40Y of set 50L. The third blade 33 would then include element 40Y of set 50J, element 40X of set 50K and element 40Z of set 50L.

The cutter element arrangement thus described and shown in rotated profile in FIG. 7 will create relatively high ridges between the cutter sets 50 in the regions designated by reference numeral 60. These ridges will tend to be higher than those created by the cutting element arrangement previously described herein. The arrangement of elements 40 shown in FIG. 7 will tend to be highly resistant to lateral movement of the bit 10 due to the increased side loading from the ridges. The bit 10 will thus tend to remain stable and resist bit vibration. Additionally, the bit 10 of FIG. 7 exhibits increased penetration rates in varying formation hardnesses, the bit initially having the characteristics of a light set and later taking on those characteristics of a heavy set bit as the more exposed elements 40X, and later, 40Y wear.

Although sets 50J–L are depicted in FIG. 7 as consisting of three elements 40 per set, the invention is in no way limited to any specific number of cutter elements 40 in a set 50. That is, a set 50 may include two, three or more elements 40 in the same set 50. Also, although each set 50 is shown in FIG. 7 to include an equal number of cutter elements 40, the number of cutter elements 40 in the sets may vary on the same bit. For example, it may be desirable to have a greater number of cutter elements 40 in a set 50 that is located at a particular radial position on the bit face 20 that is subjected to greater loading than a radial position that is not as highly loaded. Also, sets 50 may include any desired number of redundant cutters in the positions shown by cutters 40X, 40Y and 40Z in FIG. 7, as previously described with respect to FIG. 5.

Figure 8:
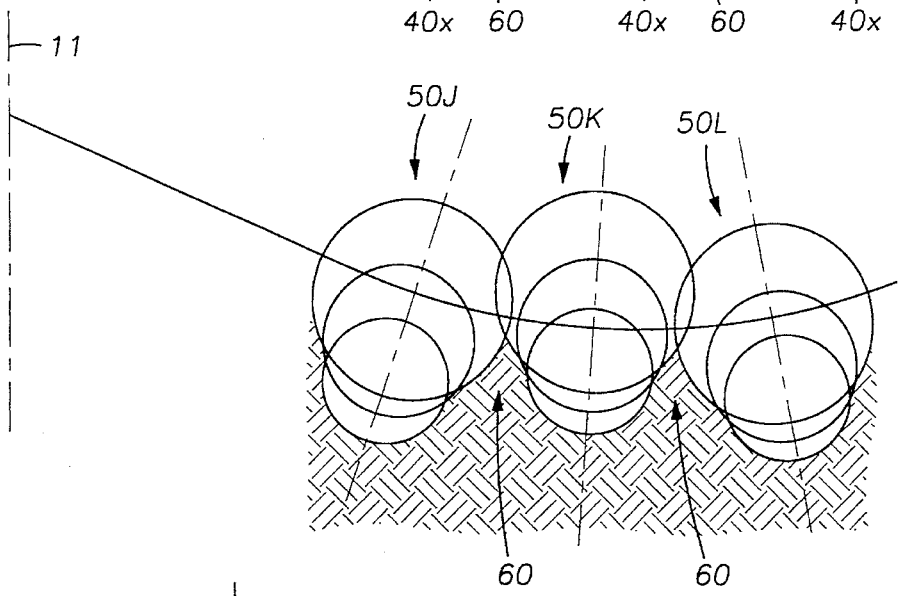

Still another alternative embodiment of the present invention is shown in FIG. 8. In this embodiment, radially adjacent cutter sets 50J–L themselves have varying degrees of exposure. More specifically, cutter elements 40X, Y and Z of sets 50J and 50L are mounted so as to protrude further from the bit face 20 than the corresponding cutter elements of set 50K. This bit 10 produces even higher ridges of formation material in region 62 than the arrangement described with reference to FIG. 7. The ridges in region 62 between cutter sets 50 again produce increased side loading relative to conventional bits, thereby increasing the stability of the bit and resisting bit vibration.

While the preferred embodiments of the invention have been shown and described, modifications thereof can be made by one skilled in the art without departing from the spirit and teachings of the invention. The embodiments described herein are exemplary only, and are not limiting. Many variations and modifications of the invention and the principles disclosed herein are possible and are within the scope of the invention. Accordingly, the scope of protection is not limited by the description set out above, but is only limited by the claims which follow, that scope including all equivalents of the subject matter of the claims.

What is claimed is:

1. A drill bit for drilling through formation material when said bit is rotated about its axis in a given direction of rotation, said bit comprising:

a bit body;

a bit face on said body;

at least one set of cutter elements disposed on said bit face;

wherein said cutter element set includes a first cutter element mounted at a first exposure height relative to said bit face for cutting a groove in the formation material when said bit is rotated, and a second cutter element mounted at a second exposure height relative to said bit face that is less than said exposure height of said first cutter element in said set, said first and second cutter elements of said set being mounted in said bit face at generally common radial positions relative to the bit axis and having cutting faces oriented in the direction of rotation of the bit for causing said cutting faces to shear formation material when said bit is rotated.

2. The drill bit of claim 1 wherein said cutter elements are arranged on said bit face in angularly spaced rows, and wherein said first and said second cutter elements of said sets are mounted in different ones of said rows.

3. The drill bit of claim 2 wherein said cutter elements of said first exposure height are disposed in a first of said rows, and wherein said cutter elements of said second exposure height are disposed in a second of said rows; and wherein said first row contains more of said cutter elements than said second row.

4. The drill bit of claim 1 having more than one set of cutter elements wherein said cutter element sets are radially spaced from one another in rotated profile of the bit;

wherein the difference between said first exposure height and said second exposure height defines an exposure variance: and wherein said exposure variance of said cutter elements in said sets differs among the sets of cutters across the bit face, said exposure variance being greater in the central portion of said bit face and decreasing upon moving from said central portion to the periphery of said bit face.

5. A drill bit for drilling through formation material when said bit is rotated about its axis, said bit comprising:

a bit body;

a bit face on said body;

at least one set of cutter elements disposed on said bit face;

wherein said cutter element set includes a first cutter element mounted at a first exposure height relative to said bit face for cutting a groove in the formation material when said bit is rotated, and a second cutter element mounted at a second exposure height relative to said bit face that is less than said exposure height of said first cutter element in said set, said first and second cutter elements of said set being mounted in said bit face at generally common radial positions relative to the bit axis; and wherein said cutter elements are arranged on said bit face in angularly spaced rows of cutter elements and wherein said cutter elements in said rows are radially spaced from each other relative to the bit axis, said rows including a plurality of said first cutter elements of said sets and a plurality of said second cutter elements of said sets.

6. The drill bit of claim 5 wherein said rows comprise alternately positioned high exposure cutter elements and low exposure cutter elements.

7. The drill bit of claim 5 wherein said first and second cutter of said set include cutting faces of substantially equal diameter.

8. A drill bit for drilling through formation material when said bit is rotated about its axis, said bit comprising:

a bit body;

a bit face on said body;

at least one set of cutter elements disposed on said bit face;

wherein said cutter element set includes a first cutter element mounted at a first exposure height relative to said bit face for cutting a groove in the formation material when said bit is rotated, and a second cutter element mounted at a second exposure height relative to said bit face that is less than said exposure height of said first cutter element in said set, said first and second cutter elements of said set being mounted in said bit face at generally common radial positions relative to the bit axis; and wherein said cutter element set further comprises a third cutter element mounted at a third exposure height relative to said bit face that is less than the exposure height of said first and second cutter elements in said set, said first, second and third cutter elements of said set being mounted in said bit face at generally common radial positions relative to the bit axis.

9. The drill bit of claim 8 wherein said set of cutter elements comprises at least three cutter elements mounted in said bit face at generally common radial positions relative to the bit axis and having cutting faces of unequal diameters, and wherein said cutter elements are mounted so that in rotated profile, said cutter element having said smallest cutting face has the greatest exposure height and said cutter element having said largest cutting face has the least exposure height.

10. A drill bit for drilling through formation material when said bit is rotated about its axis, said bit comprising:

a bit body;

a bit face on said body;

at least one set of cutter elements disposed on said bit face;

wherein said cutter element set includes a first cutter element mounted at a first exposure height relative to said bit face for cutting a groove in the formation material when said bit is rotated, and a second cutter element mounted at a second exposure height relative to said bit face that is less than said exposure height of said first cutter element in said set, said first and second cutter elements of said set being mounted in said bit face at generally common radial positions relative to the bit axis; and wherein said first and second cutter elements of said set include cutting faces, and wherein said cutting face of said first cutter element is smaller in diameter than said cutting face of said second cutter element.

11. A drill bit for drilling through formation material when said bit is rotated about its axis, said bit comprising:

a bit body;

a bit face on said body;

at least one set of cutter elements disposed on said bit face;

wherein said cutter element set includes a first cutter element mounted at a first exposure height relative to said bit face for cutting a groove in the formation material when said bit is rotated, and a second cutter element mounted at a second exposure height relative to said bit face that is less than said exposure height of said first cutter element in said set, said first and second cutter elements of said set being mounted in said bit face at generally common radial positions relative to the bit axis;

wherein said cutter elements are arranged on said bit face in angularly spaced rows, and wherein said first and said second cutter elements of said sets are mounted in different ones of said rows;

wherein said cutter elements of said first exposure height are disposed in a first of said rows, and wherein said cutter elements of said second exposure height are disposed in a second of said rows; and wherein said first row contains fewer of said cutter elements than said second row.

12. The drill bit of claim 11 further comprising a pair of blades on said bit face, said first and said second rows of cutter elements being mounted on different ones of said blades, wherein said blades are angularly spaced from one another by at least ten degrees.

13. A fixed cutter drill bit for drilling through formation material when said bit is rotated about its axis, said bit comprising:

a bit body;

a bit face on said body, said bit face including a plurality of blades and a plurality of cutter elements mounted on said blades, said cutter elements having cutting faces for cutting swaths through the formation material and being arranged in a plurality of cutter sets that are radially spaced from each other relative to the bit axis;

wherein said cutter sets comprise a plurality of angularly spaced cutter elements having element axes at generally common radial positions relative to the bit axis; and wherein each of said cutter elements of a given set are mounted on different blades and at varying cutting heights such that in rotated profile said cutting faces of said elements in said given set are out of profile relative to one another, creating an exposure variance between said cutter elements of said given set.

14. The drill bit of claim 13 wherein said bit face comprises a central portion, a gage portion, and a shoulder portion disposed between said central portion and said gage portion; and wherein said exposure variance of said cutter element sets located in said central portion is greater than said exposure variance of said cutter element sets in said shoulder portion.

15. The drill bit of claim 13 wherein said bit face comprises a central portion, a gage portion, and a shoulder portion disposed between said central portion and said gage portion; and wherein said exposure variance of said cutter element sets located in said shoulder portion is greater than said exposure variance of said cutter element sets in said gage portion.

16. The drill bit of claim 13 wherein said exposure variance of said cutter element sets differs among the sets across said bit face, said exposure variance being greater in cutter sets positioned in a central portion of said bit face and decreasing upon moving from said central portion toward the periphery of said bit face.

17. The drill bit of claim 13 wherein said cutter elements of said sets are divided and mounted on said bit face in angularly spaced rows;

wherein a first of said rows comprises cutter elements having cutting faces mounted at a first mounting height and wherein a second of said rows comprises cutter elements mounted at a second mounting height that is less than said first mounting height, said first row of cutter elements cutting deeper swaths in the formation material than said second row when the drill bit is rotated.

18. The drill bit of claim 17 wherein said second row includes more cutter elements than said first row.

19. The drill bit of claim 17 wherein said sets include at least two cutter elements mounted at the same mounting height so as to provide redundant cutter elements in said set.

20. The drill bit of claim 13 wherein said cutter elements of said sets are divided and mounted on said bit face in angularly spaced rows that include cutter elements mounted at a first height and cutter elements mounted at a second height that is less than said first height.

21. The drill bit of claim 20 further comprising;

a first row of cutter elements having a cutter element mounted at said first height and located at a first radial position relative to the bit axis; and a second row of cutter elements having a cutter dement mounted at said second height and located at said first radial position relative to the bit axis.

22. The drill bit of claim 20 wherein said rows comprise alternately positioned high exposure cutter elements and low exposure cutter elements.

23. The drill bit of claim 13 wherein said cutting faces of said cutter elements in a set have diameters that are substantially the same.

24. The drill bit of claim 13 wherein said exposure variance is substantially the same for all of said sets.

25. The drill bit of claim 13 wherein said out of profile elements in said sets are out of profile in a direction parallel to the bit axis.

26. The drill bit of claim 13 wherein said out of profile elements in said sets are out of profile in a direction parallel to said elements axes.

27. A fixed cutter drill bit for drilling through formation material when said bit is rotated about its axis, said bit comprising:

a bit body;

a bit face on said body, said bit face including a plurality of cutter elements mounted thereon and protruding therefrom, said cutter elements having cutting faces for cutting swaths through the formation material and being arranged in a plurality of cutter sets radially spaced from each other relative to the bit axis;

wherein said cutter sets comprise a plurality of angularly spaced cutter elements having element axes at generally common radial positions relative to the bit axis;

wherein said cutter elements of said sets are mounted on said bit face at varying cutting heights such that in rotate profile said cutting faces of said elements in a set are out of profile relative to one another, creating an exposure variance between said cutter elements of said set; and wherein said cutting faces of said cutter elements in a set have diameters that are not all the same.

28. The drill bit of claim 27 further comprising:

a set of cutter elements having a first cutter element having a cutting face of a first diameter, and a second cutter element having a cutting face of a second diameter that is less than said first diameter; and wherein said second cutter element is mounted on said bit face so as to have a greater exposure to the formation material than said first cutter element.

29. A fixed cutter drill bit for drilling through formation material when said bit is rotated about its axis, said drill bit comprising:

a bit body including a bit face having at least one pair of radially disposed blades, each blade pair including a first blade and a second blade angularly spaced from said first blade;

cutter elements disposed in rows on said blades, each of said rows including cutter elements radially spaced from each other relative to the bit axis, said cutter elements in said rows having cutting faces for cutting formation material and an element axis that is normal to said bit face;

wherein said cutter elements in said rows are arranged in sets, each of said sets comprising a first cutter element on said first blade and a second cutter element on said second blade having element axes at generally common radial positions relative to the bit axis and having cutting faces that are out of profile relative to one another and form an exposure variance between said cutter elements of said set.

30. The drill bit of claim 29 wherein said first cutter elements are mounted so as to be more exposed to the formation material than said second cutter elements.

31. The drill bit of claim 30 wherein said first blade includes fewer cutter elements than said second blade.

32. The drill bit of claim 30 wherein said first blade includes more cutter elements than said second blade.

33. The drill bit of claim 29 wherein said cutter elements in a set include cutting faces of substantially the same diameter.

34. The drill bit of claim 29 wherein said cutter elements in a set include cutting faces of relatively smaller and larger diameters, and wherein said cutter elements having said cutting faces of smaller diameter are mounted so as to be more exposed to the formation material than cutter elements having cutting faces of larger diameter.

35. The drill bit of claim 29 further comprising a third blade on said bit body and a third row of cutter elements mounted on said third blade; wherein said third row of cutter elements includes a third cutter element having an axis at a generally common radial position relative to the bit axis as said first and second cutter elements; and wherein said third cutter element includes a cutting face that, in rotated profile, is in profile with the cutting face of one of said cutter elements of said set and out of profile with the cutting face of the other of said cutter elements of said set.

36. The drill bit of claim 29 wherein said exposure variance is greater in sets having radial positions closer to the bit axis than for sets radially spaced further away from the axis.

37. The drill bit of claim 29 wherein said exposure variance of said sets decreases upon moving from a first radial position relative to the bit axis to a more remote radial position.

38. The drill bit of claim 29 wherein said rows comprise a first plurality of cutter elements mounted so as to have a relatively high exposure to the formation material and a second plurality of different cutter elements mounted so as to have a relatively low exposure to the formation material, the difference in exposure between said relatively high and low exposure elements defining said exposure variance of said sets.

39. The drill bit of claim 38 wherein said cutter elements are mounted in said rows in a repetitive pattern of high and low exposure elements.

40. The drill bit of claim 39 wherein said pattern comprises alternately positioned high and low exposure elements.

41. A drill bit for drilling a borehole through formation material when said bit is rotated about its central axis, said bit comprising:

a bit body:

a bit face on said body, said bit face including a plurality of blades having a leading edge for cutting the formation material when the bit is rotated; a first plurality of PDC cutter elements mounted on said blades and protruding from said bit face a first predetermined distance; and a second plurality of PDC cutter elements mounted on said blades and protruding from said bit face a second predetermined distance that is greater than said first distance;

wherein cutter elements of said first and second pluralities are mounted at generally the same radial positions with respect to the drill bit axis but in angularly spaced relationship so as to define radially spaced sets of cutter elements;

wherein said PDC cutter elements of said sets include cutting faces positioned at said leading edges of said blades; and wherein, in rotated profile, said cutting face of at least one element in a set is out of profile relative to other cutter elements in the same set.

42. The drill bit of claim 41 wherein said cutting face of said element that is out of profile is out of profile in a direction that is parallel to the bit axis.

43. The drill bit of claim 42 wherein the distance that said element is out of profile defines an exposure variance, and wherein said exposure variance is substantially the same for each of said sets having elements out of profile.

44. The drill bit of claim 41 wherein said cutter elements include axes substantially normal to said bit face and wherein said cutting face of said element that is out of profile is out of profile in a direction that is parallel to said cutter element axes.

* * * * *